US007817115B2

(12) United States Patent
Yui

(10) Patent No.: US 7,817,115 B2
(45) Date of Patent: Oct. 19, 2010

(54) IMAGE DISPLAY APPARATUS

(75) Inventor: Hideaki Yui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 990 days.

(21) Appl. No.: 11/275,151

(22) Filed: Dec. 15, 2005

(65) Prior Publication Data

US 2006/0125731 A1 Jun. 15, 2006

(30) Foreign Application Priority Data

Dec. 15, 2004 (JP) ..... 2004-362710
Dec. 12, 2005 (JP) ..... 2005-358293

(51) Int. Cl.
*G09G 3/20* (2006.01)

(52) U.S. Cl. ..... 345/76; 345/55

(58) Field of Classification Search ..... 345/58, 345/63, 76, 103
See application file for complete search history.

(56) References Cited

U.S. PATENT DOCUMENTS

| | | | | |
|---|---|---|---|---|
| 5,654,607 | A | 8/1997 | Yamaguchi et al. | 313/495 |
| 5,677,741 | A | 10/1997 | Yui | 348/649 |
| 5,734,361 | A * | 3/1998 | Suzuki et al. | 345/74.1 |
| 5,815,135 | A * | 9/1998 | Yui et al. | 345/97 |
| 5,912,713 | A | 6/1999 | Tsunoda et al. | 348/540 |
| 6,307,327 | B1 | 10/2001 | Xie et al. | 315/169.4 |
| 6,329,759 | B1 | 12/2001 | Tanaka et al. | 315/169.3 |
| 6,473,088 | B1 | 10/2002 | Matsumoto et al. | 345/530 |
| 6,538,675 | B2 | 3/2003 | Aratani et al. | 345/856 |
| 6,614,439 | B2 | 9/2003 | Matsumoto et al. | 345/530 |
| 6,870,522 | B2 | 3/2005 | Sagano et al. | 345/75.2 |

(Continued)

FOREIGN PATENT DOCUMENTS

JP 2-055492 2/1990

(Continued)

*Primary Examiner*—Alexander Eisen
*Assistant Examiner*—Stuart McCommas
(74) *Attorney, Agent, or Firm*—Fitzpatrick, Cella, Harper & Scinto

(57) ABSTRACT

An image display apparatus includes a plurality of display devices, a member arranged in the vicinity of the display devices, and a driving circuit to which an image signal corresponding to a quantity of light emitted from the light emitting region is inputted and which outputs a drive signal for driving the display devices. The driving circuit includes a correction circuit for correcting the image signal, with the drive circuit outputting the drive signal according to the corrected image signal. When the plurality of display devices is driven in accordance with the drive signal, a quantity of light emitted from a predetermined light emitting region correlating to a predetermined display device in the plurality of display devices is influenced by driving an adjacent display device and by the member. In a case where a first image signal as the image signal is inputted to the driving circuit within a first frame period, and a second image signal as the image signal is inputted to the driving circuit within a second frame period other than the first frame period, and the driving circuit outputs the drive signal corresponding to the second image signal, the correction circuit obtains a correction value to compensate for the influence caused by driving the plurality of display devices according to the drive signal corresponding to the first image signal, based on the first image signal, and the correction circuit corrects the second image signal based on the correction value and the second image signal.

3 Claims, 11 Drawing Sheets

U.S. PATENT DOCUMENTS

| | | | | |
|---|---|---|---|---|
| 7,046,219 | B2 | 5/2006 | Kanai et al. | 345/75.2 |
| 7,148,909 | B2 | 12/2006 | Yui et al. | 345/660 |
| 7,230,386 | B2 | 6/2007 | Yui et al. | 315/85 |
| 7,327,506 | B2 | 2/2008 | Yui | 358/527 |
| 2002/0171608 | A1* | 11/2002 | Kanai et al. | 345/55 |
| 2003/0107542 | A1* | 6/2003 | Abe et al. | 345/89 |
| 2005/0206958 | A1 | 9/2005 | Inamura | 358/3.23 |
| 2005/0285543 | A1 | 12/2005 | Yui et al. | 315/169.4 |
| 2005/0286062 | A1 | 12/2005 | Yui | 358/1.9 |
| 2006/0125731 | A1 | 6/2006 | Yui | 345/75.2 |
| 2006/0132394 | A1 | 6/2006 | Hayama et al. | 345/74.1 |
| 2006/0132396 | A1 | 6/2006 | Yui | 345/75.2 |
| 2006/0192493 | A1 | 8/2006 | Kanai et al. | 315/161 |
| 2007/0188526 | A1 | 8/2007 | Yui et al. | 345/690 |

FOREIGN PATENT DOCUMENTS

| | | |
|---|---|---|
| JP | 7-005836 | 1/1995 |
| JP | 2000-242214 | 9/2000 |
| JP | 2000-250463 | 9/2000 |
| JP | 2005-031636 | 2/2005 |
| JP | 2005-301218 | 10/2005 |
| JP | 2006-047989 | 2/2006 |
| JP | 03870210 | 1/2007 |
| JP | 03870214 | 1/2007 |
| JP | 03962728 | 8/2007 |

* cited by examiner

DISPLAY WHEN SCROLLING IS STOPPED

DISPLAY DURING LEFTWARD SCROLLING

DISPLAY DURING RIGHTWARD SCROLLING

DISPLAY WHEN SCROLLING IS STOPPED
(HALATION CORRECTION IS OFF)

DISPLAY WHEN SCROLLING IS STOPPED
(HALATION CORRECTION IS ON)

DISPLAY DURING LEFTWARD SCROLLING
(HALATION CORRECTION IS ON + MOVEMENT ADAPTATION OFF)

DISPLAY DURING LEFTWARD SCROLLING
(HALATION CORRECTION IS ON + MOVEMENT ADAPTATION ON)

IMAGE DISPLAY APPARATUS

BACKGROUND OF THE INVENTION

1. Field of the Invention

The present invention relates to an image display apparatus.

2. Description of the Related Art

In U.S. Pat. No. 6,307,327, as a method for controlling spacer visibility in a field emission display, a pixel data correction method is described. Defining a first region in the vicinity of a spacer and a second region not in the vicinity of the spacer, this method modifies pixel data to be transferred to the first region according to an intensity level of light generated by a plurality of pixels of the first region in the vicinity of the spacer, in order to prevent a viewer from viewing the spacer.

This method corrects data of the first region in the vicinity of the spacer but does not correct data of the second region not in the vicinity of the spacer.

SUMMARY OF THE INVENTION

An object of the present invention is to provide an image display apparatus that reduces a correction deviation.

One specific example of the object is to optimally control spacer visibility in correction that must take account of an influence range of a plurality of pixels of n number of pixels×n number of lines as in the case of correction of halation described later. In such halation correction, large-scale hardware is required to take account of the above-described influence range of a plurality of pixels. A correction method for adding delayed corrected data to original video data by utilizing correlation of the video data is effective in reduction of hardware pieces. However, there is a possibility that the corrected video data may have a deviation in correction, so that it is desired to perform this correction optimally.

According to a first aspect of the present invention, there is provided an image display apparatus comprising:

a plurality of display devices respectively having correlated light emitting regions and causing the light emitting regions to emit light so as to display an image;

a plurality of members arranged at distance of a plurality of the display devices each other; and a drive circuit for outputting a drive signal that drives the display devices, based on input image data, the drive circuit having an adjustment circuit and a correction circuit for outputting the corrected drive signal, wherein:

the correction circuit has a correction value calculation circuit for calculating a correction value that compensates for an amount that is reduced by the member from a change in quantity of light emitted from a predetermined one of the light emitting regions according to the input image data, the change being to be caused by driving of the display device having any of the light emitting region other than the predetermined light emitting region;

data to be corrected by the correction circuit is image data having a difference in time of a predetermined lapse of time with respect to image data which is input to calculate the correction value; and the adjustment circuit performs such adjustment that the corrected drive signal become a signal which is adjusted according to a change in an image to be displayed.

A "display device" as used herein is comprised of an electron-emitting device and a light emitter such as a fluorescent material that emits light when irradiated with electron emitted from this electron-emitting device in an electron beam display apparatus that uses the electron-emitting device such as a surface conduction electron-emitting device or a field emission element. In this case, a spacer functions as the above-described "member". Further, the present invention can be applied also to a plasma display apparatus. In this case, a discharge cell corresponds to the "display device" and a barrier rib that separates the discharge cells corresponds to the "member".

It is preferred that the adjustment circuit adjusts the correction value.

It is preferred that the adjustment circuit performs such adjustment that if the image to be displayed changes within the predetermined lapse of time, the image may have a smaller quantity of the correction than an image that does not change has.

It is preferred that the adjustment circuit performs adjustment based on: a correction value calculated on the basis of a range of the display device having any of the light emitting regions other than the predetermined light emitting region that changes (impinges on) a quantity of light emitted from the predetermined light emitting region owing to input image data; and image data to be corrected by the correction value.

It is preferred that the adjustment circuit performs adjustment based on: a correction value calculated on the basis of a range of the display device having any of the light emitting regions other than a predetermined light emitting region, the predetermined light emitting region making a change to (impinging on) a quantity of light emitted from the predetermined light emitting region owing to image data which is input to the correction value calculation circuit for calculation of correction values; and a correction value calculated on the basis of a range of the display device having any of the light emitting regions other than a predetermined light emitting region, the predetermined light emitting region making a change to a quantity of light emitted from the predetermined light emitting region owing to image data having a difference in time of a predetermined lapse of time with respect to image data which is input to the correction value calculation circuit for calculation of correction values.

It is preferred that the display devices each have an electron-emitting device and the correlated light emitting region which is arranged at a distance from the electron-emitting device and which emits light when irradiated with the electrons emitted from the electron-emitting device; the member is an electronic blockading member for blockading electrons due to the electrons emitted from a second electron-emitting device positioned in the vicinity of a first electron-emitting device having a first light emitting region to thereby inhibit the first light-emitting region from being irradiated with the electrons due to the electrons emitted from the second electron-emitting device; and the correction value calculation circuit calculates the correction value based on a value that corresponds to a blockaded quantity, owing to the member, of the electron emitted from the second electron-emitting device with which the first light emitting region is to be irradiated.

It is preferred that the predetermined lapse of time corresponds to duration of display of one frame or one field of an image.

According to a second aspect of the present invention, there is provided an image display apparatus comprising:

a plurality of display devices respectively having correlated light emitting regions and causing the light emitting regions to emit light so as to display an image; and a drive circuit for outputting a drive signal that drives the display devices, based on input image data, the drive circuit having an adjustment circuit and a correction circuit for outputting the corrected drive signal, wherein:

the correction circuit has a correction value calculation circuit for calculating a correction value that compensates for a change in quantity of light emitted from a predetermined one of the light emitting regions according to the input image data, the change being caused by driving of the display device having any of the light emitting regions other than the predetermined light emitting region;

data to be corrected by the correction circuit is image data having a difference in time of a predetermined lapse of time with respect to image data which is input to calculate the correction value; and the adjustment circuit performs such adjustment that the corrected drive signal become a signal which is adjusted according to a change in an image to be displayed.

According to a third aspect of the present invention, there is provided an image display apparatus comprising:

a plurality of display devices respectively having correlated light emitting regions and causing the light emitting regions to emit light so as to display an image;

a plurality of members arranged at distance of a plurality of the display devices each other; and a drive circuit for outputting a drive signal that drives the display devices, based on input image data, the drive circuit having an adjustment circuit and a correction circuit for outputting the corrected drive signal, wherein:

the correction circuit has a correction value calculation circuit for calculating a correction value that compensates for an amount that is reduced by the member from a change in quantity of light emitted from a predetermined one of the light emitting regions according to the input image data, the change being to be caused by driving of the display device having any of the light emitting regions other than the predetermined light emitting region";

data to be corrected by the correction circuit is image data having a difference in time of a predetermined lapse of time with respect to image data which is input to calculate the correction value; and the adjustment circuit performs adjustment if correction by use of the correction value results in over-correction.

It is preferred that the adjustment circuit does not perform adjustment if correction by use of the correction value does not result in over-correction and performs adjustment if correction by use of the correction value results in over-correction.

It is preferred that the adjustment circuit: defines a characteristic value related to an image of a predetermined frame as a first characteristic value and a characteristic value related to an image of a frame that occurs later than the predetermined frame as a second characteristic value; and decides whether the first characteristic value satisfies a decision condition that is set as related to the first characteristic value and whether the second characteristic value satisfies a decision condition that is set as related to the second characteristic value and, if both of the decision conditions are satisfied, performs the adjustment.

It is preferred that the adjustment circuit: defines a characteristic value related to an image of a predetermined frame as a first characteristic value and a characteristic value related to an image of a frame that occurs later than the predetermined frame as a second characteristic value; and performs the adjustment if a result of comparison between the first characteristic value and the second characteristic value satisfies a predetermined condition.

According to a fourth aspect of the present invention, there is provided an image display apparatus comprising:

a plurality of display devices respectively having correlated light emitting regions and causing the light emitting regions to emit light so as to display an image; and a drive circuit for outputting a drive signal that drives the display devices, based on input image data, the drive circuit having an adjustment circuit and a correction circuit for outputting the corrected drive signal, wherein:

the correction circuit has a correction value calculation circuit for calculating a correction value that compensates for a change in quantity of light emitted from a predetermined one of the light emitting region according to the input image data, the change being caused by driving of the display device having any of the light emitting regions other than the predetermined light emitting region;

data to be corrected by the correction circuit is image data having a difference in time of a predetermined lapse of time with respect to image data which is input to calculate the correction value; and the adjustment circuit performs adjustment if correction by use of the correction value results in over-correction.

It is preferred that the adjustment circuit does not perform adjustment if correction by use of the correction value does not result in over-correction and performs adjustment if correction by use of the correction value results in over-correction.

It is preferred that the adjustment circuit: defines a characteristic value related to an image of a predetermined frame as a first characteristic value and a characteristic value related to an image of a frame that occurs later than the predetermined frame as a second characteristic value; and decides whether the first characteristic value satisfies a decision condition that is set as related to the first characteristic value and whether the second characteristic value satisfies a decision condition that is set as related to the second characteristic value and, if both of the decision conditions are satisfied, performs the adjustment.

It is preferred that the adjustment circuit: defines a characteristic value related to an image of a predetermined frame as a first characteristic value and a characteristic value related to an image of a frame that occurs later than the predetermined frame as a second characteristic value; and performs the adjustment if a result of comparison between the first characteristic value and the second characteristic value satisfies a predetermined condition.

By the present invention, it is possible to both reduce costs and alleviate a harmful effect due to a correction deviation.

DESCRIPTION OF THE PREFERRED EMBODIMENTS

First Embodiment

The following will describe in detail the first embodiment of the present invention.

The present invention can be applied to a display apparatus using a surface conduction electron-emitting device, a field emission display apparatus (FED), a plasma display apparatus (PDP), an organic EL display apparatus, etc. In an electron beam display apparatus such as an FED or a display apparatus that uses a surface conduction electron-emitting device, there is a possibility that halation may be caused on a peripheral pixel by brightness of a luminescent spot that has self-emitted. Therefore the electron beam display apparatus is a preferable embodiment which the present invention may be applied to. The plasma display apparatus is another preferable embodiment to which the present invention may be applied, because there is a possibility of halation (cross-talk) occurring onto a peripheral pixel similarly if there is no barrier rib (which corresponds to "member") between discharge cells (which corresponds to "display device") or if a structure of the barrier rib exceeds a unit pixel in size.

Figure 2:
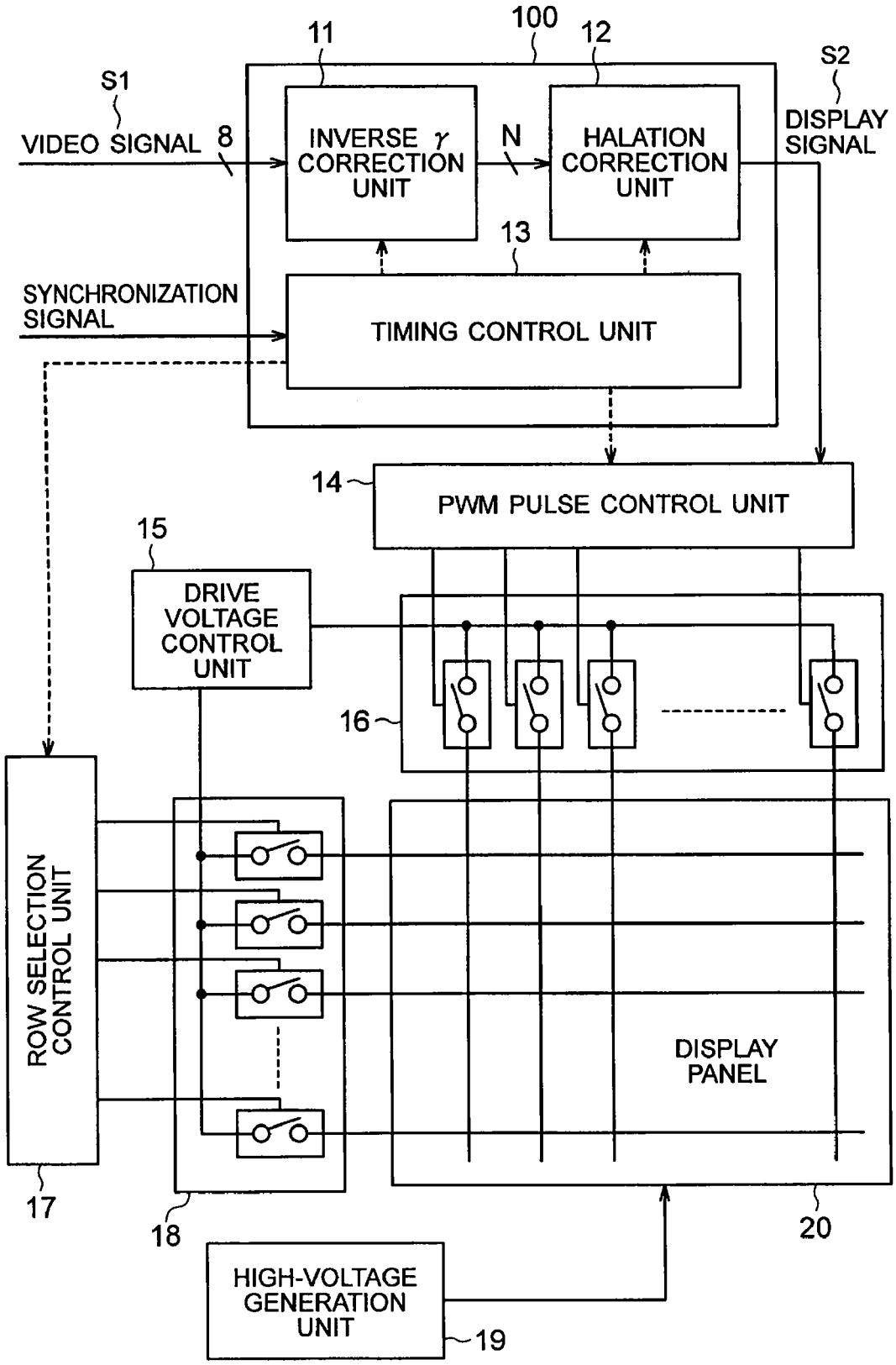
FIG. 2 is a block diagram of the image display apparatus related to the embodiment of the present invention.

First, a configuration of an image display apparatus of the present embodiment is described with reference to FIG. 2. A display panel 20 comprises a multi-electron source in which a plurality of electron-emitting devices (for example, cold cathode devices) is arrayed on a substrate and an image forming member (for example, fluorescent material) for forming (displaying) an image when irradiated with electrons, the multi-electron source and the image forming member being arranged opposite each other in a thin vacuum vessel. The electron-emitting devices are wired in a simple matrix by using row-directional wiring electrodes and column-directional wiring electrodes, so that electrons are emitted from the device selected by column electrode/row electrode biases. By accelerating these electrons with a high voltage, these electrons collide with the fluorescent material and light is emitted. In the present embodiment, a surface conduction electron-emitting device is used as the electron-emitting device. A configuration and a manufacturing method of a display panel using the surface conduction electron-emitting device are disclosed in detail in Japanese Patent application laid-Open publication No. 2000-250463, which is hereby incorporated by reference.

The following will describe operations from a step of inputting a video signal to this display panel 20 to a step of displaying a video. A signal S1 indicates an input video signal. A signal processing unit 100 performs display-optimal processing on the signal S1 to output a display signal S2. In FIG. 2, as for functions of the signal processing unit 100, only such a function block is given as to be minimum required to describe the present embodiment. Reference numeral 11 denotes an inverse γ correction unit. Generally, the input video signal S1 is transmitted or recorded after being subjected to nonlinear transformation such as the 0.45'th power referred to as gamma transformation that matches input vs. light emission characteristics of a CRT display on the assumption that an video due to the input video signal S1 is displayed on the CRT display apparatus. To display the video due to the video signal on a display apparatus that uses a surface conduction electron-emitting device or a display device having linear input vs. light emission characteristics such as an FED or a PDP, it is necessary to perform inverse gamma transformation such as the 2.2'th power on the input signal. The input signal S1 for the inverse γ correction unit 11, which is often input in eight to ten bits for each color, has been generally subjected to such transformation as to increase quantity of data to ten bits (optionally 12 to 14 bits) in order to avoid extinction of tone in dark region owing to nonlinear inverse gamma transformation. Output data of the inverse γ correction unit 11 has been transformed in such a manner as to provide a linear relationship between brightness of the display panel and the data. The output data is input to a halation correction unit 12. The halation correction unit 12 is described in detail later. From the halation correction unit 12, a display signal S2 is output which displays a video optimal to the display panel 20. A timing control unit 13 generates and outputs a variety of timing signals for operations of the blocks, based on a synchronization signal handed over together with the input video signal S1.

A PWM pulse control unit 14 transforms (PWM modulation in the present embodiment) the display signal S2 into a drive signal adapted to the display panel 20 for each horizontal cycle (row selection period). A drive voltage control unit 15 controls a voltage that drives the devices arranged on the display panel 20. A column wiring switch unit 16, which is comprised of switch means such as a transistor, applies for each horizontal cycle (row selection period) an driving voltage from the drive voltage control unit 15 to the column electrode on the panel only when a PWM pulse is output from the PWM pulse control unit 14. A row selection control unit 17 generates a row selection pulse that drives the devices on the display panel 20. A row wiring switch unit 18, which is comprised of switch means such as a transistor, provides to the display panel 20 an output of the drive voltage control unit 15 according to a row selection pulse output from the row selection control unit 17. A high-voltage generation unit 19 generates an acceleration voltage that accelerates electrons emitted from the electron-emitting device arranged on the display panel 20 so that the electrons may collide with the fluorescent material. In such a manner, the display panel 20 is driven to display the video.

It is to be noted that in the present embodiment, a drive circuit of the present invention is comprised of the signal processing unit 100, the PWM pulse control unit 14, the drive voltage control unit 15, the column wiring switch unit 16, the row selection control unit 17, and the row wiring switch unit 18. Further, a correction circuit of the present invention is comprised of a halation correction unit 12.

Next, the halation correction unit 12 is described with reference to FIG. 1.

Before description with reference to FIG. 1, what is halation is explained below.

Figure 3A:
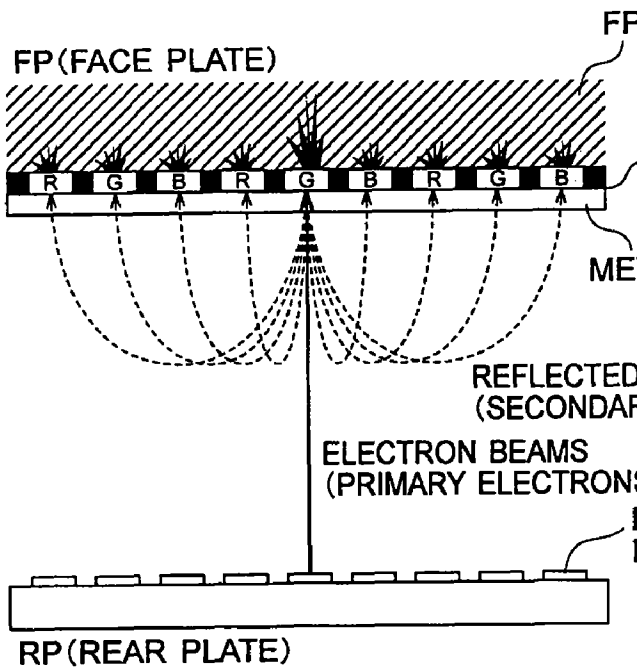
FIGS. 3A and 3B are explanatory diagrams of a mechanism of occurrence of halation not in the vicinity of a spacer.
Figure 3B:
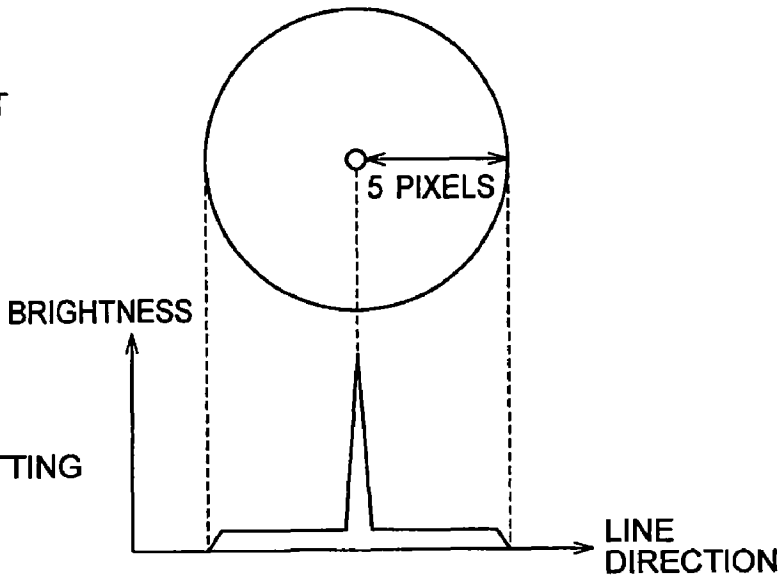
Figure 5:
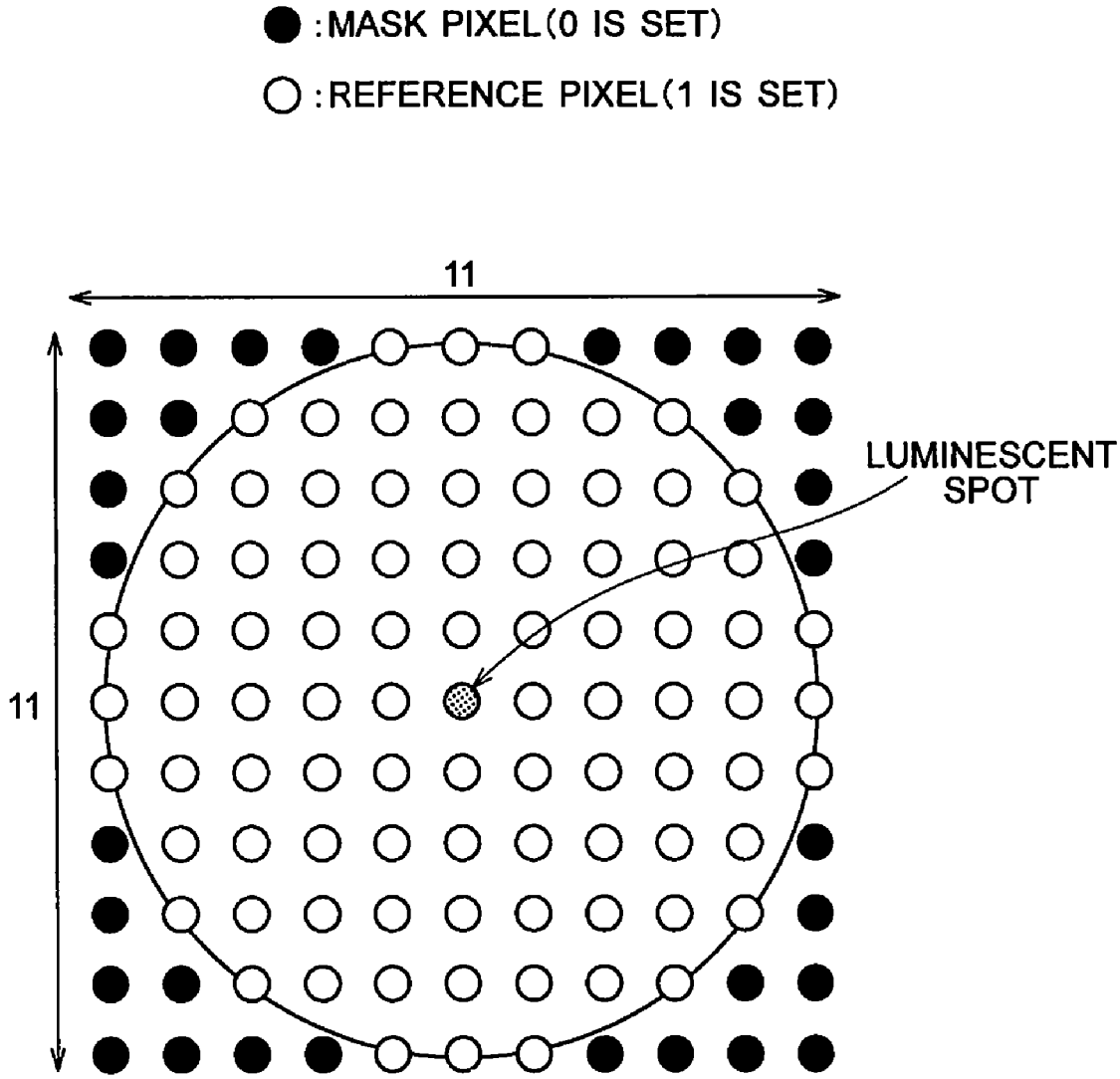
FIG. 5 is a halation mask pattern diagram having 11 pixels× 11 pixels.

FIG. 3A shows an image display apparatus for using electron-emitting devices formed on a rear plate and light emitters (red, blue, and green fluorescent materials in the present embodiment) arranged on a face plate having space with the electron-emitting devices, to irradiate these light emitters with electron beams (primary electrons) emitted from the electron-emitting devices, thereby causing the light emitters to emit light. The present inventor has found such a problem peculiar to this type of image display apparatus that color reproducibility is different from a desired state. Specifically, for example, if only the blue fluorescent material is irradiated with electrons to emit blue color light, not pure blue color but light having a color slightly mixed with another color, that is, light in which green and red colors are mixed is emitted, with poor color saturation. The present inventor has studied hard and, as a result, found out the cause of the deterioration of the saturation. Primary electrons emitted from the electron-emitting device impinge on the light emitter that corresponds to this electron-emitting device so that this corresponding light emitter may emit light at its luminescent spot. But, these primary electrons are reflected by this light emitter and impinge on close (and adjacent) light-emitting regions of different colors as reflected electrons (secondary electrons) so that its peripheral light emitter may also emit light, thereby deteriorating the color saturation. A phenomenon that a display device emits light by an influence from the drive of adjacent display devices, such as light emission due to reflected electrons, is referred to as "halation" in the present specification. In a display apparatus using a surface conduction electron-emitting device, as shown in FIG. 3B, it was found that when a fluorescent material is irradiated with electrons, pixels around it emit light in a circle owing to halation (light emission is distributed in a cylinder around a luminescent spot if expressed in terms of brightness as a quantity of emitted light). If a radius of this circular region influenced by halation is as long as n number of pixels, a filter as large as (2n+1) number of taps is required as pixel reference range for halation correction processing, as described in detail later. Furthermore, it was found that the radius of a region influenced by halation can be uniquely determined reasonably practically by a distance between the face plate on which the fluorescent material is arranged and the rear plate on which the electron source is arranged, a size of the pixels, etc. Therefore, if the distance between the face plate and the rear plate is known, the number of filter taps is determined uniquely. Since n is five (n=5) pixel in the present embodiment, it can be known that the number of filter taps is 11, that is, it is necessary to reference data of 11 pixels×11 lines as shown in FIG. 5 in order to accommodate an influence of halation.

Figure 4B:
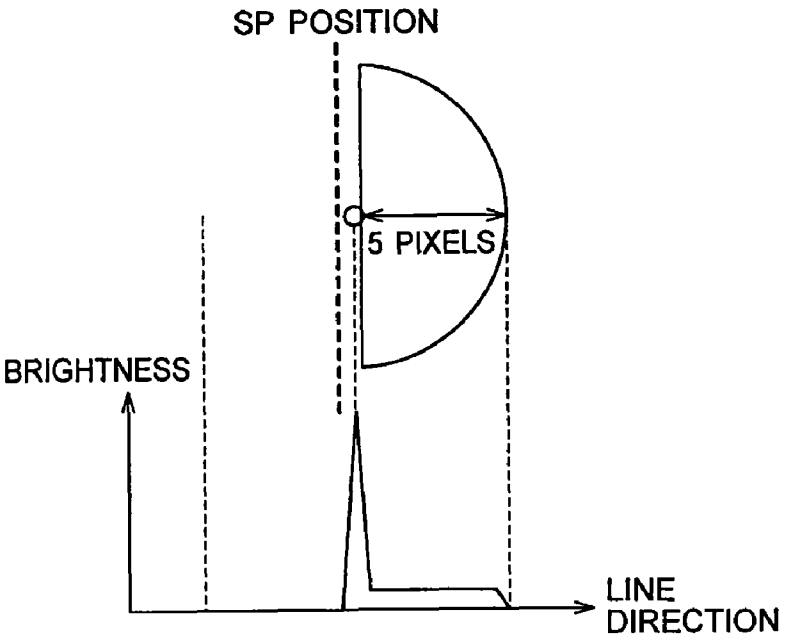
FIGS. 4A and 4B are explanatory diagrams of the mechanism of occurrence of halation in the vicinity of a spacer.
Figure 4A:
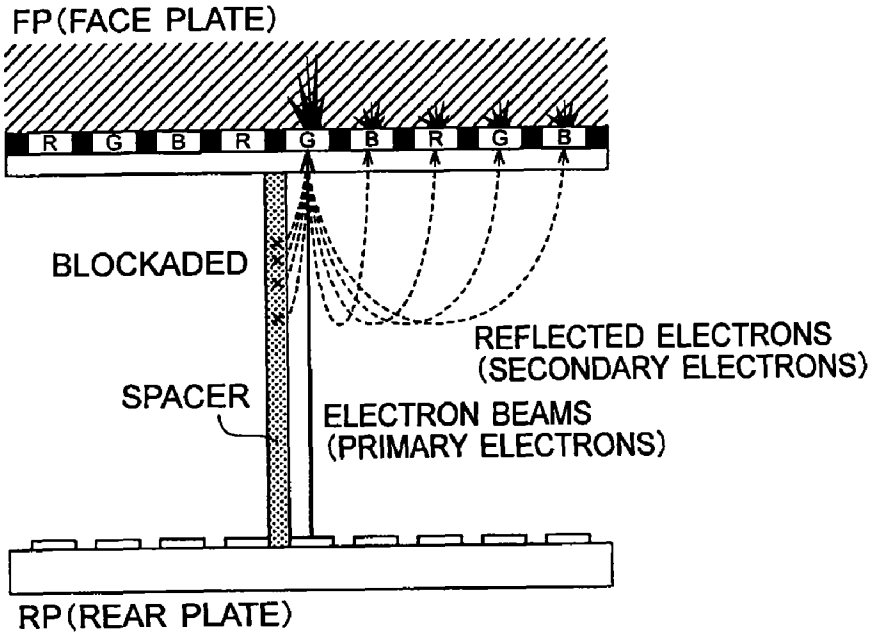

FIGS. 3A and 3B show a case where there is no blockading member such as a spacer (region not in the vicinity of a spacer) on a trajectory of reflected electrons. On the contrary, FIG. 4A shows a case where there is an electron blockading member such as a spacer (region in the vicinity of a spacer), which spacer blockades reflected electrons (secondary electrons) so that a halation intensity diminishes. Therefore, in a case where electron beams (primary electrons) are emitted from the electron-emitting device closest to the spacer, it was found that halation has an influence on a semicircular light-emitting range as shown in FIG. 4B. These operations have been given to explain a halation occurring mechanism with reference to an example of one-device driving.

Figure 7A:
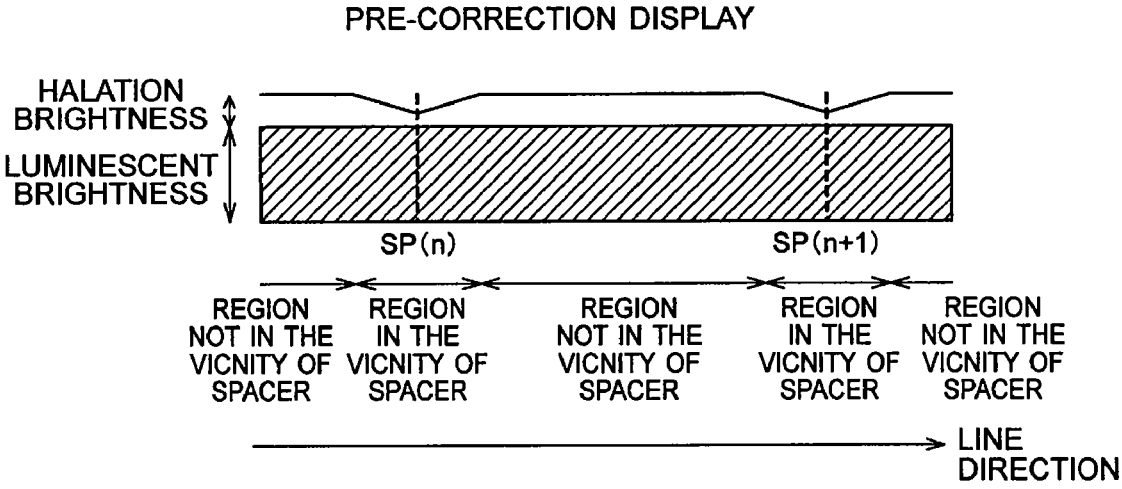
FIGS. 7A and 7B are conceptual diagrams of halation correction by means of addition.

In the display panel used in the present embodiment, a plurality of spacers has been arranged at intervals (distance) of several tens of lines in a line direction. Arranging the spacers so as to accommodate all of the lines increases the cost problematically. Therefore it is optimal to give spacing of at least 15 lines (15 devices) between the spacers. The spacers may have a variety of shapes. The present embodiment has employed a sheet-shaped spacer that is arranged along the horizontal line in the display panel and has the length corresponding to the width of the display panel. The present inventor has discussed a case where light of the same color is emitted all over the surface in such a configuration that the spacers are set up at an intervals of several devices. It was found that in this configuration, a quantity of halation is different between the above-described region in the vicinity of the spacer and the region not in the vicinity of the spacer. It was confirmed that the difference in quantity of halation causes an inherent problem that color purity varies in the vicinity of the spacer. This problem is referred to as spacer unevenness. A degree of spacer unevenness varies with a light emission pattern of displayed images. For example, when blue light is emitted all over the surface, halation brightness is added to brightness of the emitted blue light as shown in FIG. 7A. This halation brightness indicates a variation in light emitted from a predetermined light emitting region according to input image data, the variation caused by the drive of display devices in a light emitting region other than the predetermined light emitting region. A region in the vicinity of the spacer has a step-wise variation in blockaded quantity of reflected electrons depending on a distance from the spacer, so that a step-wise wedge-shaped variation having a width as large as about 10 lines is recognized visually in color purity. This wedge-shaped drop in brightness accounts for such a quantity of halation brightness as to be reduced by the spacer.

It is to be noted that brightness can be used as the quantity of light emitted from the predetermined light emitting region. However, it is desirable to take account of halation from devices of any horizontal lines other than a light emitting region of a predetermined horizontal line. Therefore, specifically, a integral of the brightness of this light emitting region over a predetermined period (one frame period, one vertical scanning period, etc.) may by employed as the quantity of light emitted from a predetermined light emitting region.

The inventor has studied hard and, as a result, found a configuration of a novel image display apparatus that is able to solve the above problems and a method for correcting a drive signal. The following will describe specific examples of the image display apparatus and the drive signal correcting method with reference to FIG. 1.

Original image data input to the halation correction unit 12 has been output from the inverse γ correction unit 11. This original image data is supposed to have been input in n-bits for each of R, G, and B colors. To perform correction taking account of a range influenced by halation as described above, it is necessary to use a filter having 11×11 taps in a configuration of the display panel employed by the present embodiment, so that a memory for at least 11 lines is required to perform arithmetic processing. In the present example, a capacity M of a line memory required in correction is estimated by the following equation.

$$\text{Line memory capacity } M = \text{number of horizontal pixels} \times n(\text{bits}) \times \text{RGB} \times 11(\text{lines}) \quad \text{(Equation 1)}$$

To provide full-HD and high-tone display with the number of horizontal pixels=1920 (pixels) and n=14 (bits), equation gives a correction line memory capacity=1920×14×3×11=887 (K bits), which is a vast value. A person skilled in the art will easily understand that chip costs are increased greatly if an arithmetic processing memory having such a large-capacity data processing memory is mounted as it is in a signal processing LSI.

A configuration that is able to reduce such a correcting line memory capacity is described below with reference to FIG. 1. A thinning processing unit 1 thins original data and hands it over to a first memory 2. The present embodiment has employed two methods for thinning original data.

The first method reduces the number of reference bits by referencing only high-order m bits of the n-bit original data (n>m). In this case, a value of m is determined so as to provide an error ratio that does not reduce an operational accuracy of halation correction. If the above-described inverse γ correction unit 11 outputs n (=12 to 14) bits, experiments showed that the number of bits can be reduced to eight (m=8). This is because a halation quantity is calculated by multiplying the total quantity of light emitted from the reference pixels by a predetermined minute coefficient. Since the coefficient as the multiplier is minute, a calculation result is influenced only slightly even if a value of low-order bits of the original data is ignored.

The second method approximates the above-described range influenced by halation not in RGB sub-pixel units but in pixel units. Specifically, quantities of light emitted from the R, G, and B sub-pixels are summed as pixel (m+2(bits))=R(m(bits))+G(m(bits))+B(m(bits)) so that a resultant sum may represent the total quantity of light emitted from the pixels.

According to the two methods for thinning original data, the capacity of a line memory is given as follows.

$$\begin{aligned}\text{Line memory capacity } M' &= \text{number of horizontal pixels} \times m(\text{bits}) \times ((m+2)/3m)RGB \times 11(\text{lines}) \\ &= (m/n) \times ((m+2)/3m) \times M \\ &= (8/14) \times (10/24) \times M \\ &= 0.24 \times M\end{aligned} \quad \text{(Equation 2)}$$

It is thus possible to reduce the capacity of the first memory 2 to 213 K bits (24% of 887 K bits) without reducing correction accuracy.

Figure 6:
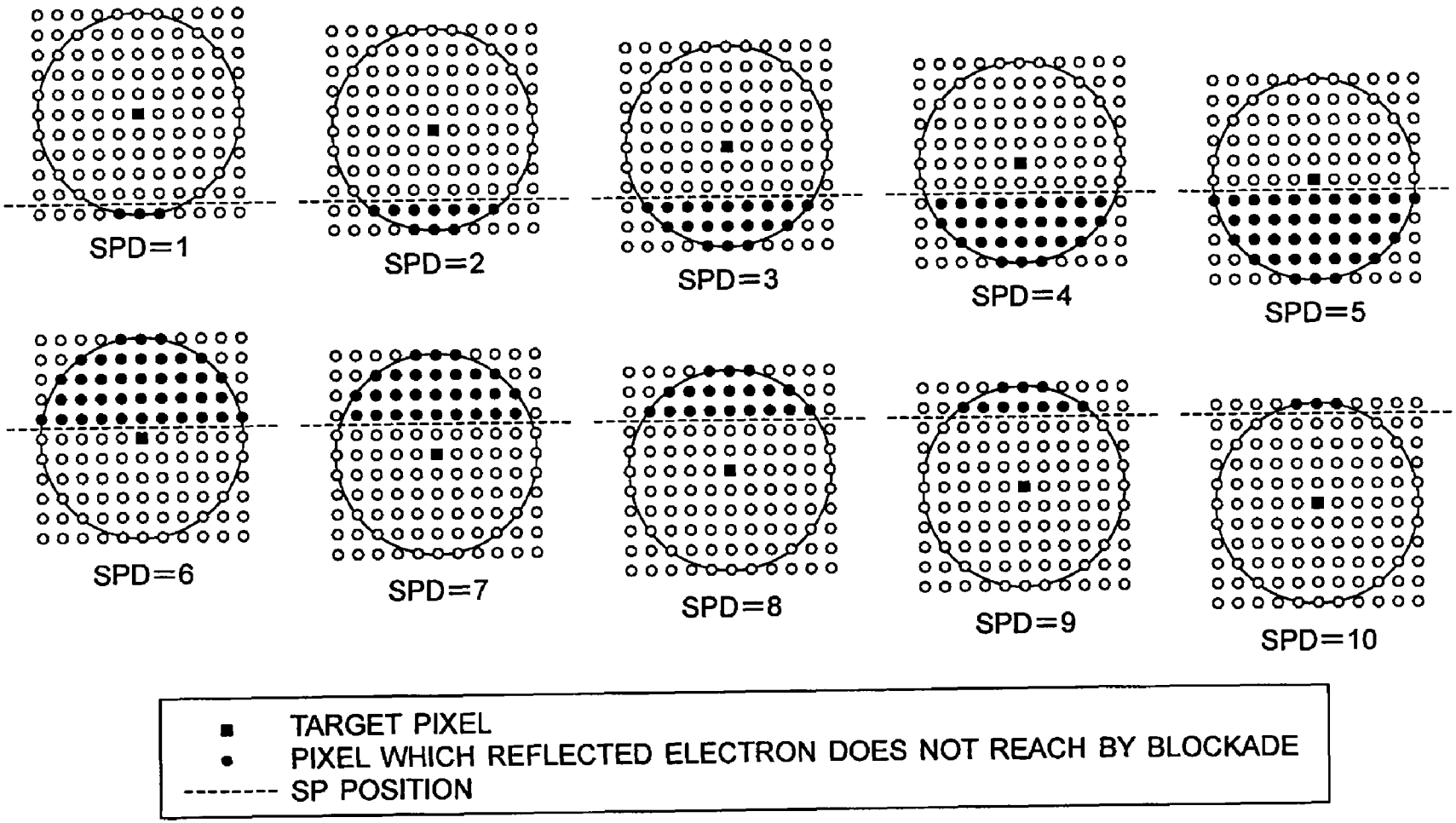
FIG. 6 is a correspondence diagram of pixel regions in which reflected electrons are blockaded according to a distance between a target pixel and the spacer.

Outputs of the thinning processing unit 1 are serially written in the unit of a line to the first memory 2 comprised of 11 line memories. Each time 11 lines of data is stored, 11 pixels×11 lines of data pieces are read simultaneously from the 11 line memories. Preferably the first memory 2 is configured to enable such simultaneous reading, so that it is optimal to constitute the line memory of an SRAM. For this purpose, it is preferable to use an ASIC or a RAM in a LSI such as an FPGA. An interpolation unit 3, to interpolate information removed by the thinning unit, multiplies the 11 pixels×11 lines of data read simultaneously by $2^{n-m}$. First, a selective addition unit 4 masks 11 pixels×11 lines of data by using a halation mask pattern that indicates information of peripheral pixels influenced by reflected electrons shown in FIG. 5 (which reduces quantity of pixels in a masked region to 0). Next, the selective addition unit 4 selectively adds only electrons blockaded by a spacer of reflected electrons from surrounding pixels to a target pixel in the vicinity of the spacer. A spacer position information generation unit 5 judges a positional relationship between the target pixel and the spacer based on an SPD value (Spacer Distance), which is a value indicative of the positional relationship between the target pixel and the spacer. The SPD value is generated on the basis of a timing control signal and spacer position information which are received from the timing control unit 13. As for the target pixel in the vicinity of the spacer, there are ten patterns of the pixel to which the reflected electrons can not reach because of blockade by the spacer as shown in FIG. 6. Each of the patterns is assigned an SPD value of 1 to 10. A total quantity of emitted light related to the blockaded quantity can be obtained by selecting pixels shown in gray according to an SPD value and summing all values of these pixels. Since reflected electrons from pixels not in the vicinity of the spacer are not blockaded by the spacer, a result of the summing may be assumed to be 0. A coefficient multiplication unit 6 multiplies the summation result with a coefficient (halation gain value) that indicates a percentage by which the summation result has been blockaded. The coefficient ordinarily takes on a value between 0 and 1, which is about 1.5% for the panel of the present embodiment. A correction value calculated by the coefficient multiplication unit 6 is stored in a second memory 7. The second memory 7 serves to adjust a timing in such a manner that a correction value thus calculated may correspond to a predetermined pixel position (which corresponds to the calculated correction value) of original image data (to be corrected) which is given not via the first memory 2. Since the present embodiment performs a one-frame delay operation, the second memory 7 serves as a frame buffer which stores correction values. The second memory 7 functions as a timing adjustment buffer and, therefore, may preferably be constituted of an inexpensive device such as an externally attached DRAM. A correction value read from the second memory 7 a one-frame lapse of time later is added by a correction operation unit 8 to the original image data as shown in the following equations and output as corrected data (which is, however, described on the assumption that a corrected-quantity adjusting multiplication unit 10 shown in FIG. 1 does not exist, as a matter of convenience of order of explanation).

$$\begin{aligned}\text{Rout} &= \text{Rin} + \text{correction value} \\ \text{Gout} &= \text{Gin} + \text{correction value} \\ \text{Bout} &= \text{Bin} + \text{correction value}\end{aligned} \quad \text{(Equation 3)}$$

Figure 7B:
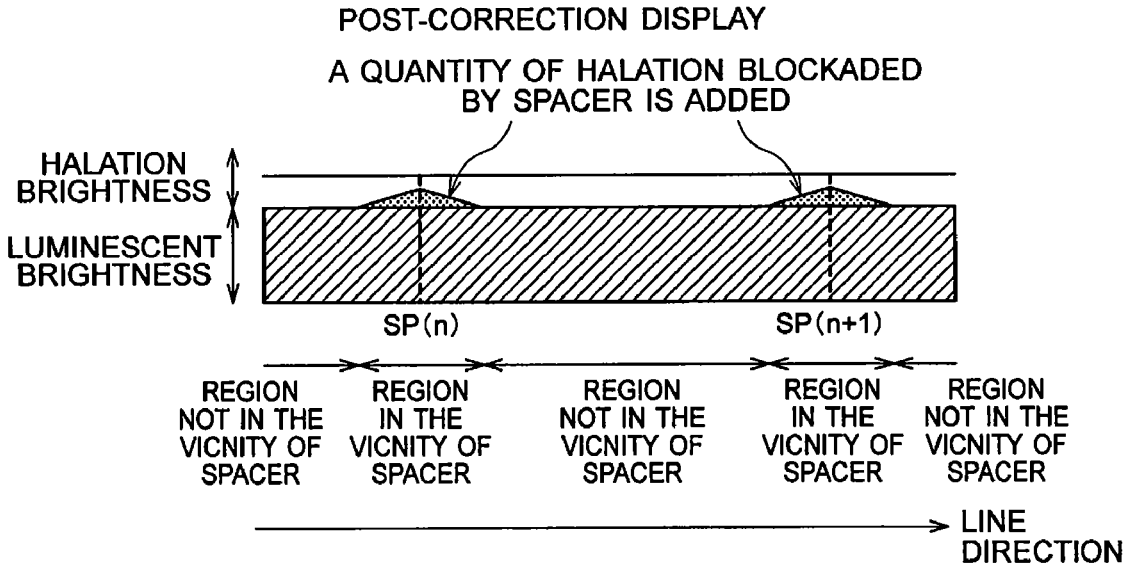

In such a manner, a pre-correction step-wise variation in color purity in the vicinity of the spacer such as shown in FIG. 7A is corrected by adding halation, which would have occurred without the blockade by the spacer, to brightness in the vicinity of the spacer as shown in FIG. 7B. Therefore, a difference in color purity between a region not in the vicinity of the spacer and a region in the vicinity of the spacer is reduced all over the surface of the screen, thereby correcting spacer unevenness due to the halation.

As described above, the halation correction circuit has such a configuration as to have the first memory and the second memory separated from each other, to perform correction operations by using these memories separated from each other. It is thus possible to reduce the scale of the circuit and the costs without deteriorating correction accuracy. By reflecting corrected data on a one-frame later situation by using such a method as described above, good correction results can be obtained. This is because an ordinary video has a strong inter-frame correlation and there are many cases where a one-frame-delayed difference cannot be detected. It is to be noted that it is possible to employ such a configuration that a correction value obtained from an image signal that corresponds to a predetermined frame is used to correct an image signal that is delayed by two frames or more with respect to the predetermined frame. However, the more the delay is, the more difficult it becomes to expect a correlation between the frames. Thus, such a configuration is optimal as to perform one-frame-delayed correction.

Figure 8A:
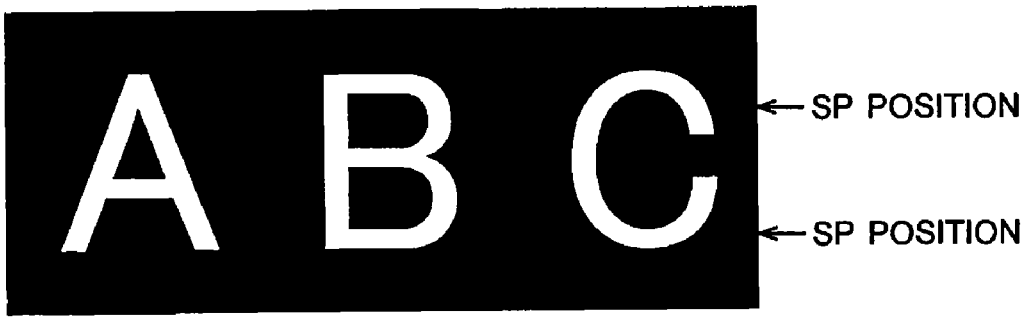
FIGS. 8A, 8B, and 8C are diagrams showing mis-corrected display in high-speed character scrolling.
Figure 8B:
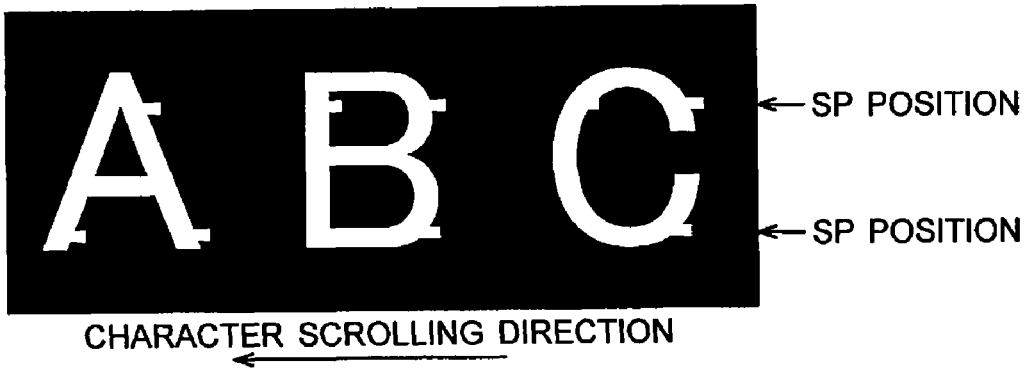
Figure 8C:
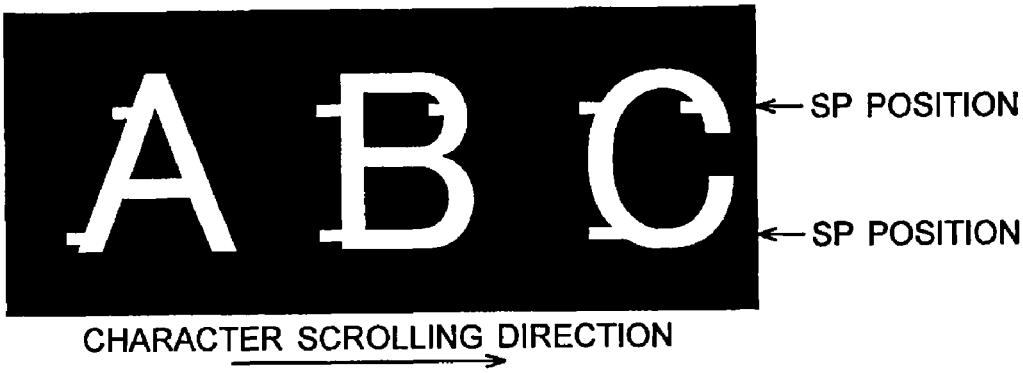

In this case, the present inventor found that a problem may occur even if there is a correlation to some extent between a frame of an image signal from which correction value is obtained and a frame of an image signal to be corrected according to the correction value. In a video in which a high-brightness image moves speedily in a dark background, there are some cases where harmful effects due to a correction deviation may cause a problem. For example, in a video shown in FIG. 8 in which bright white characters are scrolled speedily in a dark background, a mis-corrected pattern similar to trailing appears in a correction region in the vicinity of a spacer, thereby deteriorating an image quality. It was found that this deterioration in image quality appears as annoyance that can be sufficiently recognized visually (it is to be noted a specific value of "to be speedily" refers to a speed of moving by several tens of dots for each vertically scanning, although it may vary with conditions of the display panel). FIG. 8A is a display example where scrolling is stopped. In this case, naturally no correction deviations occur. In the case of FIG. 8B where characters are scrolled leftward speedily, a mis-corrected pattern appears on the right sides of the characters. In the case of FIG. 8C where the characters are scrolled rightward speedily, on the other hand, a mis-corrected pattern appears on the left sides of the characters.

The following will describe a method of alleviating the above-described deterioration in image quality.

Figure 9A:
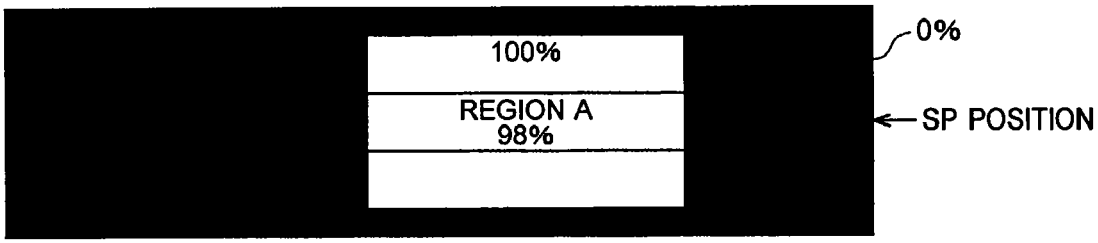
FIGS. 9A, 9B, 9C and 9D are explanatory diagrams of a mechanism of occurrence of a mis-corrected pattern.
Figure 9B:
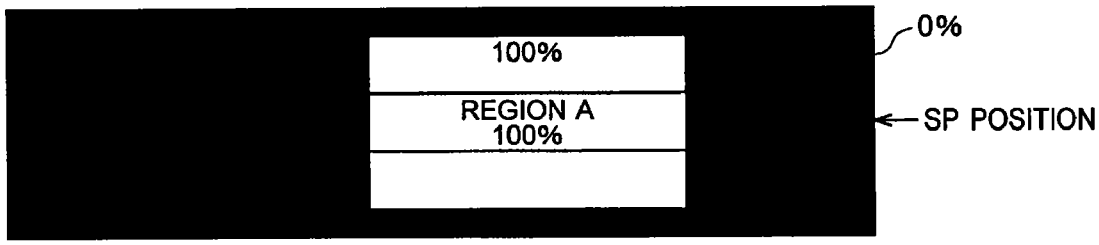
Figure 9C:
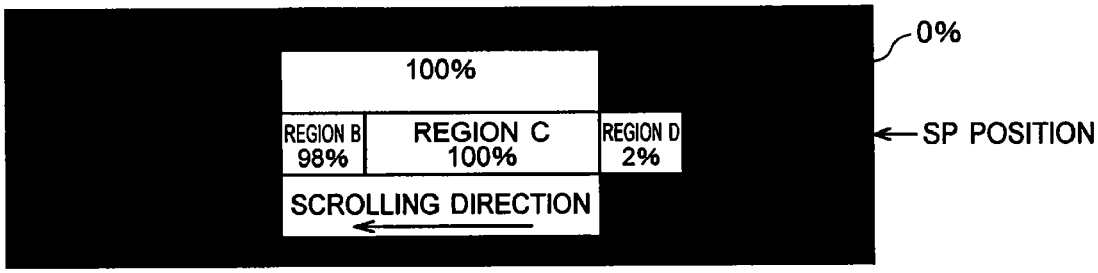

First, a mechanism of occurrence of a mis-corrected pattern shown as a phenomenon in FIG. 8 is described with reference to FIG. 9. FIG. 9A shows a display example where scrolling is stopped and a 100% white patch stands still in a 0%-brightness background. In a case where no halation correction is performed, region A in the vicinity of a spacer is darker by about 2% in average because reflected electrons are blockaded by the spacer (which is shown dark evenly for convenience of explanation, although actually it is step-wise dark as shown in FIG. 7A). By performing halation correction on this region A, this region is corrected to have 100% brightness as shown in FIG. 9B. Next, as shown in FIG. 9C, when the 100%-white patch is scrolled leftward speedily, a region in the vicinity of the spacer is roughly divided into three regions of region B (98% brightness), region C (100% brightness), and region D (2% brightness) according to a difference in inter-frame movement. The region B has brightness of 0% of the previous frame of FIG. 9B. Therefore, the region B is corrected with correction quantity of 0 and the brightness after correction is the same as brightness (98%) of FIG. 9A where no halation correction is performed. The region C, where a data region of the previous frame and that of the current frame overlap, has the same correction quantity before and after scrolling and so is corrected to have 100% brightness. The region D has 100% brightness of the previous frame of FIG. 9B. Therefore, in the region D, a corrected quantity of 2% brightness is added to a dark background of the current frame of 0% brightness. In such a manner, the region D is subject to over-correction because 2% brightness is further added to the region which does not need correction.

Although such a mechanism results in the regions B and D being mis-corrected, especially a mis-corrected pattern of the region D can be easily recognized. This is probably because generally the human eyes are more sensitive to a change in brightness of a darker region than that of a brighter region.

From the above, the present inventor thought that the problems during high-speed scrolling can be handled with by alleviating deterioration in image quality of the over-corrected region D of FIG. 9C in the present embodiment. He then got an invention for deciding whether conditions that easily cause over-correction are satisfied or to which degree these conditions are satisfied and adjusting a correction value based on a result of the decision. Further, specifically, the conditions that easily cause over-correction may include a movement (change) in an image at a position of a target pixel to be corrected or a degree of the movement (change). To detect whether there is a movement in an image or a degree of the movement, movement detecting methods are known in a field of image processing. For example, such a configuration is known that when compressing moving image data, a movement vector is detected and the data is compressed based on a result of the detection. The present invention may also employ a variety of movement detecting methods. However, it need not detect a movement strictly in contrast to the case of compressing moving image data and so can preferably employ a simple configuration. The following will describe a specific method. A movement-adaptive control unit 9 of FIG. 1 is configured so that it can reference original image data (Rin, Gin, and Bin) and a correction value read from the second memory 7. As described above, there is a delay of one frame between the correction value and the original image data. In such a configuration, two kinds of decisions are made. Specifically, two types of decision threshold values given in the following respective equations are set.

$$\text{Correction value} > \text{decision threshold value 1} \quad \text{(Equation 4)}$$

$$\text{Rin} < \text{decision threshold value 2} \quad \text{(Equation 5)}$$

$$\text{Gin} < \text{decision threshold value 2} \quad \text{(Equation 6)}$$

$$\text{Bin} < \text{decision threshold value 2} \quad \text{(Equation 7)}$$

The condition of (Equation 4) is established to detect a magnitude of a correction value because an image quality of the region D of FIG. 9C is deteriorated more remarkably as a quantity of halation to be corrected increases.

The conditions of (Equation 5), (Equation 6), and (Equation 7) are established to detect a level of original image data because the image quality of the region D of FIG. 9C is deteriorated more remarkably as a level of original image data to be corrected (correction-subject signal) decreases.

It is to be noted that the decision threshold values 1 and 2 may be set appropriately depending on a configuration of the display apparatus. It is desirable to select a best value for each of them on a trial-and-error basis. It is desirable to avoid such a situation that correction may be turned off even though a correction value is sufficiently small or that correction is not performed sufficiently. Therefore, preferably the decision threshold value 1 may be set to 2% or more of the number of tones of correction-subject signals. For example, if the correction-subject signals (Rin, Gin, and Bin) are each an 8-bit signal, the number of tones is 256, so that a value of six or more can be employed optimally. Further, it is desirable to avoid such a situation that a correction value may be applied as it is without being adjusted even though the correction value is sufficiently large (and the correction-subject signals are sufficiently small in magnitude). Therefore, preferably the decision threshold value 1 may be not larger than 20% of the number of tones of the correction-subject signals. In the present embodiment the decision threshold value 1 is set to 10.

Further, it is desirable to avoid such a situation that correction may be turned off or may not be performed sufficiently even though the correction-subject signals are sufficiently large in magnitude. Therefore, preferably the decision threshold value 2 may be not larger than 10% of the number of tones of the correction-subject signals. Further, it is desirable to avoid such a situation that a correction value may be applied as it is without being adjusted even though the correction-subject signals are sufficiently small in magnitude (and the correction value is sufficiently large). Therefore, preferably the decision threshold value 2 may be 2% or more of the number of tones of the correction-subject signals. The decision threshold value 2 was set to 16 in the present embodiment.

Figure 9D:
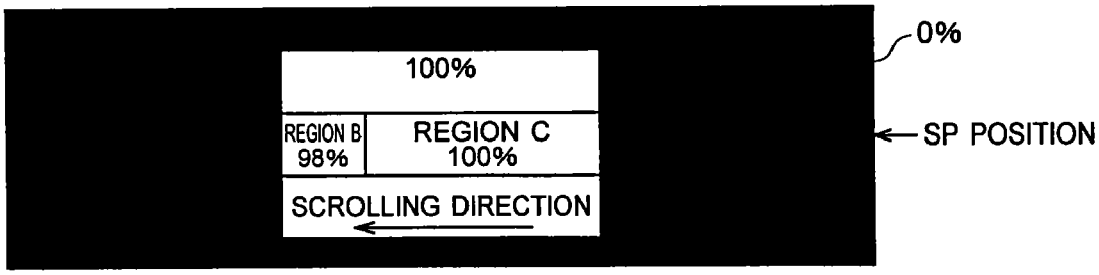

If the conditions of (Equation 4), (Equation 5), (Equation 6), and (Equation 7) are satisfied simultaneously, the movement-adaptive control unit 9 sets to 0.0 an adjustment gain to be handed over to a correction-quantity adjustment/multiplication unit 10 and, otherwise, 1.0 so that turn-ON/OFF control may be performed on dynamic halation correction. This control eliminates over-correction in the region D of FIG. 9C, thereby providing such display as shown in FIG. 9D. That is, it is possible to alleviate deteriorations in image quality owing to a mis-corrected pattern generated during high-speed character scrolling such as shown in FIG. 8. In other words, by adjusting a correction quantity adaptively only on such a region as to have a movement, it is possible to reduce the costs and, at the same time, alleviate harmful effects due to a correction deviation. Further, processing to adjust a quantity of correction by an adjustment circuit constituted of the movement-adaptive control unit 9 and the correction-quantity adjustment/multiplication unit 10 can be performed only by adding a simple comparison operational circuit to a circuit to calculate a correction value, thereby inexpensively configuring the circuit without increasing its scale.

It is to be noted that a reason why it is optimal to make the two kinds of decision, that is, a decision (Equation 4) of a relationship between a correction value and a threshold value and a decision (Equations 5, 6, and 7) of a relationship between correction-subject data and the threshold value is as follows. That is, image data used to obtain a correction value and image data to be corrected are deviated time-wise (by one frame of delay in the present embodiment) from each other. It is to be noted that a correction value may be said to be a characteristic value related to an image of a frame and data to be corrected maybe said to be a characteristic value related to an image that occurs later than that frame. Here, a characteristic value refers to image data itself or a value obtained from the image data by performing predetermined operations. A movement is decided simply by respectively using the characteristics values related to images of different frames as parameters of the decision conditions.

Although the present embodiment has employed the same decision threshold value that satisfies conditions of (Equation 5), (Equation 6), and (Equation 7), different parameters may be employed. Furthermore, although the present embodiment has referenced original image data pieces separately from each other as in (Equation 5), (Equation 6), and (Equation 7), they may be averaged, for example, changed as in the following equations, thus obtaining the same effects expectedly.

$$\text{Correction value} > \text{decision threshold value 1} \quad \text{(Equation 4)}$$

$$\text{Rin}+\text{Bin}+\text{Gin} < \text{decision threshold value 3} \quad \text{(Equation 8)}$$

Although an example has been described where an adjustment gain is set to 0.0 to turn off halation correction if the above conditions are satisfied, such a value of the adjustment gain that a deterioration in image quality of the region D of FIG. 9C would not be conspicuous may be selected from a range of 0.0<adjustment gain<1.0, to reduce a correction value by using the correction-quantity adjustment/multiplication unit 10, if the above conditions are satisfied. Further, although such an especially optimal configuration as to adjust a correction value has been described, a configuration to adjust data after being corrected by using a correction value can be employed.

In the above-described embodiment, a correction value calculation circuit of the present invention is comprised of the thinning processing unit 1, the first memory 2, the interpolation unit 3, the selective addition unit 4, the coefficient multiplication unit 6, and the second memory 7. Further, the adjustment circuit of the present invention corresponds to the movement-adaptive control unit 9 and the correction-quantity adjustment/multiplication unit 10.

A hardware quantity can be reduced greatly by employing the above-described system of performing correction operations by thinning reference data at the time of halation operation from original data, delaying post-operation corrected data by one frame, and adding it to the original data by utilizing inter-frame correlation of a video. Furthermore, by using the above-described movement-adaptive halation correction, it is possible to reduce mis-corrected patterns even in such a video that a high-brightness image, which causes harmful effects on frame delaying, may move speedily in a dark background.

Second Embodiment

Figure 10:
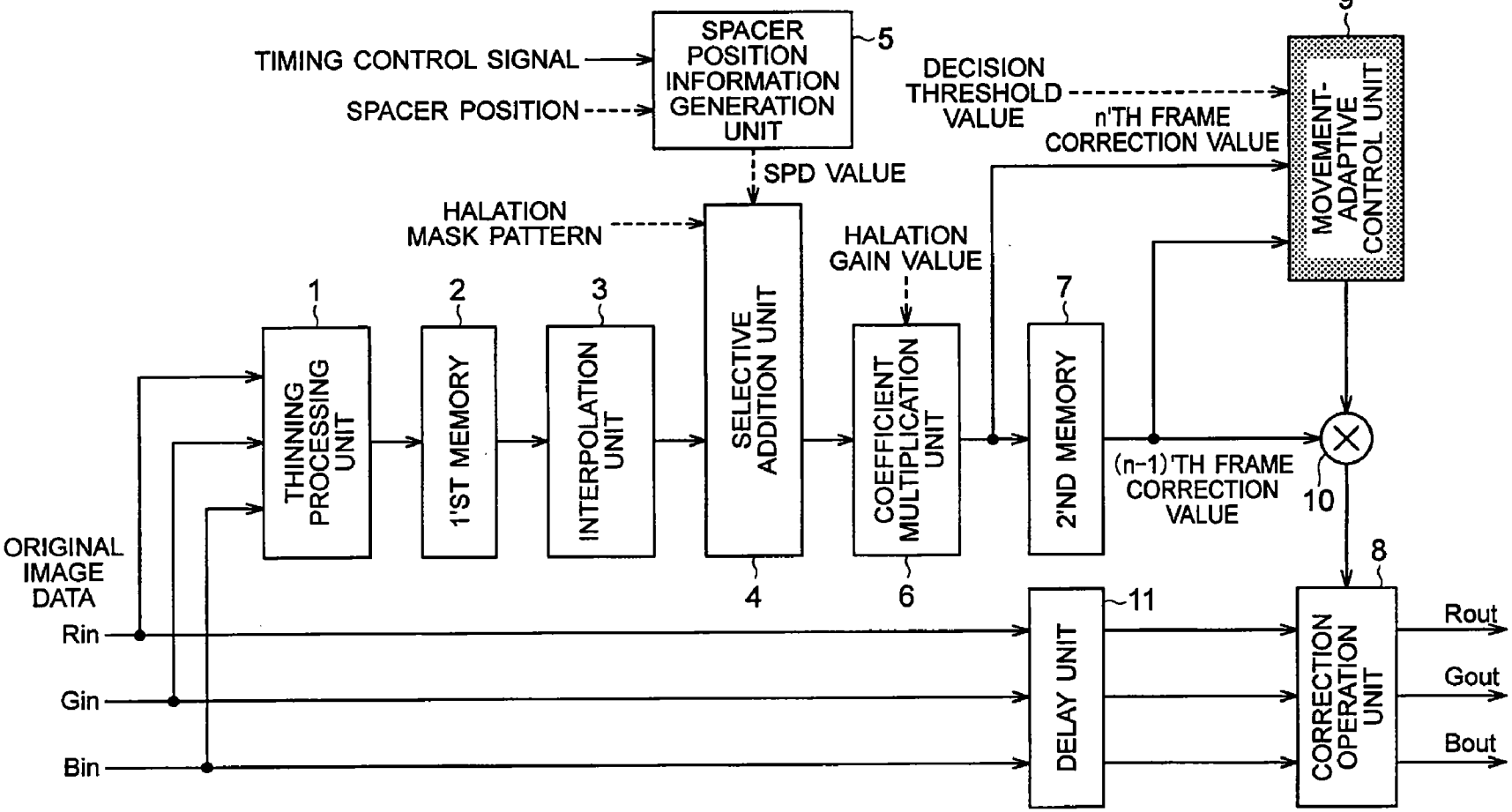
FIG. 10 is a block diagram of a halation correcting unit of an image display apparatus related to a second embodiment of the present invention.

The first embodiment has been described about method for adjusting a correction value on original image data based on correction value and original image data with reference to a movement-adaptive halation correction. In the present embodiment, similar movement-adaptive halation correction is performed by using a plurality of correction values calculated in different frames respectively. A correction value adjustment method of the present embodiment is described with reference to FIG. 10. FIG. 10 is different from FIG. 1 in that a movement-adaptive control unit 9 references only an n'th frame correction value and an (n−1)'th frame correction value but not original image data. And a delay unit 11 is added in FIG. 10. The present embodiment employs the same halation correction method as that of the first embodiment.

Figure 11:
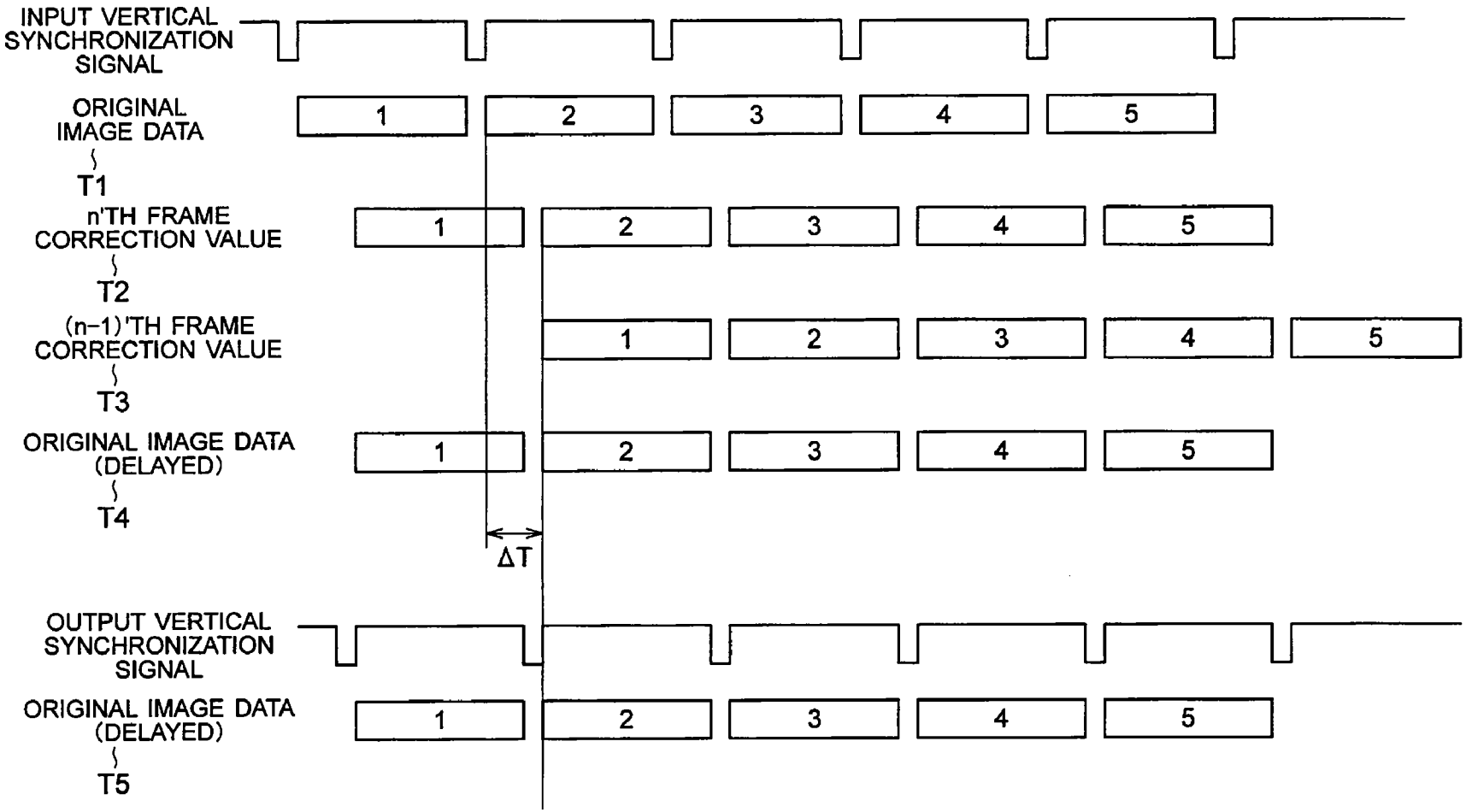
FIG. 11 is a timing chart related to the block diagram of FIG. 10.

In FIG. 10, original image data is input in synchronization with an input vertical synchronization signal at a timing of T1 as shown in a timing chart of FIG. 11 (in which reference numerals denote frame numbers). A calculated halation correction value is written to a second memory at timing T2 delayed from T1 by a delay ΔT through a first memory 2. This is assumed to be an n'th frame correction value. Data read from the second memory 7 is output at timing T3 delayed by one frame from timing T2. This is assumed to be an (n−1)'th frame correction value.

Next, the movement-adaptive control unit 9 of FIG. 10 is described. This block is configured to reference the n'th frame correction value and the (n−1)'th frame correction value, where there is a time delay of one frame between the correction value and the original image data as described above. In such a configuration, two kinds of decision conditions are set. Specifically, two types of decision threshold values given by the following equations are set.

$$(n-1)\text{'th frame correction value} > \text{decision threshold value 1} \quad \text{(Equation 9)}$$

$$n\text{'th frame correction value} < \text{decision threshold value 2} \quad \text{(Equation 10)}$$

The condition of (Equation 9) is established because an image quality of a region D of FIG. 9C is deteriorated more remarkably as a quantity of halation calculated in the previous frame increases. The condition of (Equation 10) is established because an image quality of the region D of FIG. 9C is deteriorated more remarkably as the quantity of halation calculated in a current frame decreases. If the conditions of (Equation 9) and (Equation 10) are satisfied simultaneously, the movement-adaptive control unit 9 sets to 0.0 an adjustment gain to be handed over to the correction-quantity adjustment/multiplication unit 10 and, otherwise, 1.0 so that turn-ON/OFF control may be performed on dynamic halation correction. This control eliminates over-correction in the region D of FIG. 9C, thereby providing such display as shown in FIG. 9D. That is, it is possible to alleviate deterioration in image quality owing to a mis-corrected pattern generated during high-speed character scrolling such as shown in FIG. 8.

Besides the conditions of Equations 9 and 10, a decision condition can be established taking account of a fact that an inter-frame difference of a calculated halation correction value is correlated with movement information. That is, an (n'th frame correction value) and an ((n−1)'th frame correction value) are characteristic values obtained under the same conditions and, therefore, can be compared to each other directly without undergoing any special processing. Therefore, it is possible also to establish a decision condition on a result of comparison between both of the correction values (characteristic values). Specifically, the same effects can be obtained if (Equation 9) and (Equation 10) are changed as follows.

$$|(n\text{'th frame correction value})-((n-1)\text{'th frame correction value})|>\text{decision threshold value 3} \quad \text{(Equation 11)}$$

Although an example has been described where the adjustment gain is set to 0.0 to turn off halation correction if the conditions of the present embodiment are satisfied, if these conditions are satisfied, such an adjustment gain may be selected from a range of 0.0<adjustment gain<1.0 that a deterioration in image quality of the region D of FIG. 9C may not be conspicuous, so as to reduce a correction value by using the correction quantity adjustment/multiplication unit 10.

Correction data adjusted by any one of the methods is corrected by a correction operation unit 8. It is to be noted that it is necessary to adjust original image data not at timing T1 but timing T5 delayed by as much as ΔT given through the delay unit 11.

As described above, by employing movement-adaptive halation correction, as in the case of the first embodiment, it is possible to reduce mis-corrected patterns even in such a video that a high-brightness image, which has harmful effects on frame delaying, may move speedily in a dark background.

Further, in the present embodiment, an inter-frame difference in correction value calculated from a region subjected to an influence of halation is utilized, so that costs are increased because of a memory required for the delay unit 11, but a movement-adaptive accuracy is improved as compared to the first embodiment. This is because in the present embodiment a current frame references only one pixel of original image data in contrast to the first embodiment in which a previous frame references a correction value calculated from a region subjected to an influence of halation. In such a case, if there is a small dark region in a large bright region (for example, there is a black mask character in a white background), there is a possibility that it is judged to be moving even if it is stands still (the conditions of Equations 4, 5, 6, and 7 are satisfied). However, in the present embodiment, the previous frame and the current frame both reference a correction value calculated from a region subjected to an influence of halation, so that the above-described mis-judgment is not liable to occur.

However, actually, good movement-adaptive halation correction can be performed by any of the methods according to the first and second embodiments. It is to be noted that in the above embodiments, a configuration which utilizes an output of a correction circuit has been described to judge a change (movement) in an image. Although these embodiments are especially preferred, any other movement detection method may be utilized. Although a configuration which adjusts a correction value by using an adjustment circuit has been described as an especially preferred embodiment, such a configuration may be employed as to adjust correction-subject data to be corrected on the basis of a correction value or data corrected on the basis of a correction value.

Third Embodiment

In the above embodiments, such a configuration has been described as to calculate a correction value that corresponds to a portion that does not have effect due to blockade by a spacer, of an increment in brightness that would have been given by a pixel positioned in the vicinity of a correction-subject pixel to brightness of the correction-subject pixel. The correction value obtained by this calculation is calculated with respect to correction-subject data in such a manner as to increase a magnitude of the correction-subject data.

The present embodiment, on the other hand, employs a configuration to calculate a correction value corresponding to an increment in brightness which a pixel positioned in the vicinity of a correction-subject pixel gives to brightness of the correction-subject pixel. In this case, brightness of a correction-subject pixel is corrected, using an obtained correction value, so that it decreases by as much as a quantity of an increment in brightness given by a pixel positioned in the vicinity.

Figure 1:
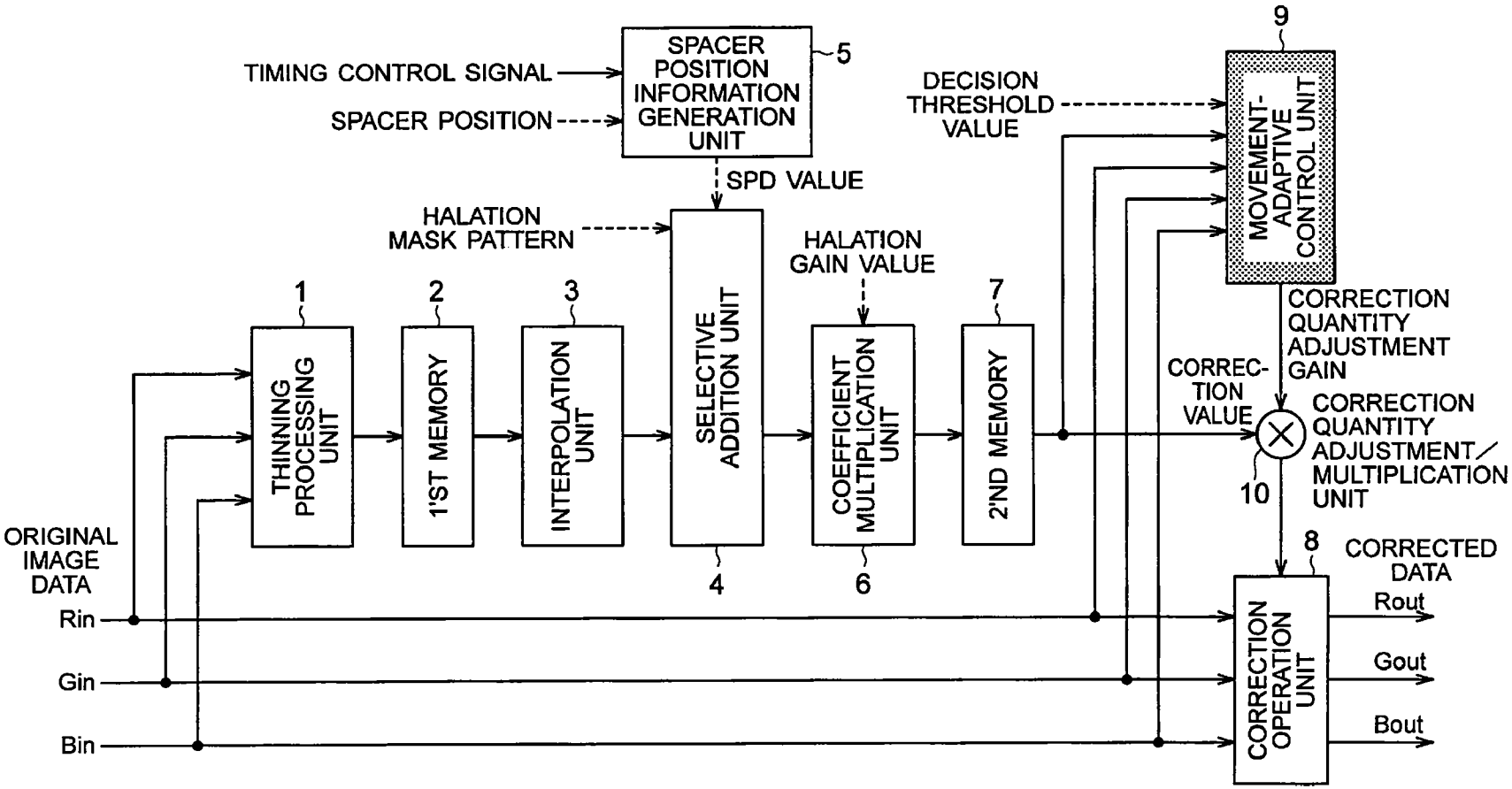
FIG. 1 is a block diagram of a halation correcting unit of an image display apparatus related to a first embodiment of the present invention.

The present embodiment employs the same configuration of the halation correction unit as that of FIG. 1. However, it is different from the first and second embodiment in operations of the selective addition unit 4, the correction operation unit 8, and the movement-adaptive control unit 9.

The operations are as follows in case where a correction-subject pixel is sufficiently distant from a spacer and in case where it is positioned in the vicinity of the spacer, respectively.

Case Where a Correction-subject Pixel is Sufficiently Distant from a Spacer

If there is no spacer between a correction-subject pixel and pixels (nearby pixels) that can have an influence due to halation on the correction-subject pixel, the correction-subject pixel is not influenced by a blockade of halation by the spacer. Therefore, a selective addition unit 4 integrates all of data of the nearby pixels (11×11 pixels) and outputs it.

Case Where a Correction-subject Pixel is Positioned in the Vicinity of a Spacer

Data pieces are summed of only those of pixels in the vicinity of a spacer that are positioned on the same side of a correction-subject pixel with respect to the spacer. That is, in contrast to the first and second embodiments where data pieces of pixels placed at positions indicated in gray in FIG. 6 have been integrated, in the present embodiment, data pieces of pixels placed at positions indicated by a white circle within a circle having a halation radius are integrated.

A correction value is calculated by using an integrated value thus obtained, as in the case of the first and second embodiments.

According to a configuration of the present embodiment, an increment in brightness owing to halation is decreased by correction, so that the correction operation unit 8 performs processing to subtract a correction value output from a correction-quantity adjustment/multiplication unit 10 from correction-subject data.

In this configuration of the present embodiment, a display pattern that over-correction becomes conspicuous is different from that of the first and second embodiments. However, they are the same in that a proper decision is made by deciding whether characteristic values of images of two frames satisfy the decision conditions or by comparing these two characteristic values each other directly. Therefore, in the movement-adaptive control unit 9, patterns display is generated under a variety of conditions, to set the proper decision conditions (such as a magnitude of decision threshold values, a magnitude relationship between the decision threshold value and a correction value, a magnitude relationship between correction-subject data and the decision threshold value, etc).

As may be clear from the above, the present embodiment can be applied also to a configuration using no spacer. In the case of a display panel using no spacer or member corresponding to a spacer, the above-described processing of the case where a correction-subject pixel is sufficiently distant from the spacer may be performed over the entire region.

Although a display apparatus using a surface conduction electron-emitting device has been exemplified, any other display apparatus may encounter cross talk such as halation described above. For example, in a plasma display apparatus, plasma generated by one device may have an influence on brightness of nearby device. Further, in case of a liquid crystal display apparatus or an organic EL display apparatus, a drive voltage applied on one device may have an influence on a drive voltage applied on nearby devices. In these display apparatuses also, cross talk can be corrected much the same way as in the cases of the embodiments described in detail above. It is to be noted that in a transmissive liquid-crystal display apparatus using a backlight or a projecting light source in combination, a light emitting region refers to a region where light passes through. A reflective liquid-crystal display apparatus, on the other hand, a light emitting region refers to a region that reflects light.

This application claims priority from Japanese Patent Application No. 2004-362710 filed on Dec. 15, 2004 and Japanese Patent Application No. 2005-358293 filed on Dec. 12, 2005, which are hereby incorporated by reference herein.

What is claimed is:

1. An image display apparatus comprising:

a rear plate having a plurality of electron emitting devices;

a face plate having a plurality of light emitting regions which correspond to each electron emitting device respectively;

a spacer provided between the rear plate and the face plate; and a driving circuit including a correction circuit for obtaining a correction value from an image signal of a first frame and correcting the image signal of a second frame using the correction value, the second frame being subsequent to the first frame, the driving circuit driving the plurality of the electron emitting devices based on the corrected image signal corrected by the correction circuit, wherein a quantity of light emitted from a predetermined light emitting region is influenced by an amount of primary electrons from the corresponding electron emitting device and an amount of secondary electrons from an adjacent light emitting region, and wherein in a case where the quantity of light emitted from the predetermined light emitting region is reduced because at least some of the secondary electrons from the adjacent light emitting region are blocked by the spacer, the correction circuit obtains a correction value, corresponding to the reduced light emission amount due to blocking of the secondary electrons by the spacer, from the image signal of the first frame, and performs a correction by adding the correction value to the image signal for the corresponding electron emitting device of the second frame, the correction circuit includes a decision unit for comparing a first value that is a first correction value obtained from the image signal of the first frame with a first threshold value and comparing a second value that is the image signal for the corresponding electron emitting device of the second frame with a second threshold value, and uses a value obtained by multiplying the first value by an adjustment gain which is less than one as the correction value to be added to the image signal for the corresponding electron emitting device in case where the first value is greater than the first threshold value and the second value is less than the second threshold value.

2. An image display apparatus comprising:

a rear plate having a plurality of electron emitting devices;

a face plate having a plurality of light emitting regions which correspond to each electron emitting device respectively;

a spacer provided between the rear plate and the face plate; and a driving circuit including a correction circuit for obtaining a correction value from an image signal of a first frame and correcting the image signal of a second frame using the correction value, the second frame being subsequent to the first frame, the driving circuit drives the plurality of the electron emitting devices based on the corrected image signal corrected by the correction circuit, wherein a quantity of light emitted from a predetermined light emitting region is influenced by an amount of primary electrons from the corresponding electron emitting device and an amount of secondary electrons from an adjacent light emitting region, and wherein in a case where the quantity of light emitted from the predetermined light emitting region is reduced because at least some of the secondary electrons from the adjacent light emitting region are blocked by the spacer, the correction circuit obtains a correction value, corresponding to the reduced light emission amount due to blocking of the secondary electrons by the spacer, from the image signal of the first frame, and performs a correction by adding the correction value to the image signal for the corresponding electron emitting device of the second frame, the correction circuit includes a decision unit for comparing a first correction value that is obtained from the image signal of the first frame with a first threshold value and comparing a second correction value that is obtained from the image signal of the second frame with a second threshold value, and uses a value obtained by multiplying the first correction value by an adjustment gain which is less than one as the correction value to be added to the image signal for the corresponding electron emitting device in case where the first correction value is greater than the first threshold value and the second correction value is less than the second threshold value.

3. An image display apparatus comprising:

a rear plate having a plurality of electron emitting devices;

a face plate having a plurality of light emitting regions which correspond to each electron emitting device respectively;

a spacer provided between the rear plate and the face plate; and a driving circuit including a correction circuit for obtaining a correction value from an image signal of a first frame and correcting the image signal of a second frame using the correction value, the second frame being subsequent to the first frame, the driving circuit driving the plurality of the electron emitting devices based on the corrected image signal corrected by the correction circuit;

wherein a quantity of light emitted from a predetermined light emitting region is influenced by an amount of primary electrons from the corresponding electron emitting device and an amount of secondary electrons from an adjacent light emitting region, and wherein in a case where the quantity of light emitted from the predetermined light emitting region is reduced because at least some of the secondary electrons from the adjacent light emitting region are blocked by the spacer, the correction circuit obtains a correction value, corresponding to the reduced light emission amount due to blocking of the secondary electrons by the spacer, from the image signal of the first frame, and performs a correction by adding the correction value to the image signal for the corresponding electron emitting device of the second frame, the correction circuit includes a decision unit for comparing an absolute value of a difference between a first correction value that is obtained from the image signal of the first frame and a second correction value that is obtained from the image signal of the second frame with a threshold value, and uses a value obtained by multiplying the first correction value by an adjustment gain which is less than one as the correction value to be added to the image signal for the corresponding electron emitting device in case where the absolute value of the difference is greater than the threshold value.

* * * * *